US006756553B1

(12) United States Patent
Yamaguchi et al.

(10) Patent No.: US 6,756,553 B1
(45) Date of Patent: Jun. 29, 2004

(54) SWITCH UNIT

(75) Inventors: Yoshihiro Yamaguchi, Toyota (JP); Iori Sugiura, Toyota (JP)

(73) Assignee: Kojima Press Industry Co., Ltd., Toyota (JP)

( * ) Notice: Subject to any disclaimer, the term of this patent is extended or adjusted under 35 U.S.C. 154(b) by 0 days.

(21) Appl. No.: 10/670,536

(22) Filed: Sep. 25, 2003

(30) Foreign Application Priority Data

Jun. 30, 2003 (JP) ..... 2003-186060

(51) Int. Cl.[7] ..... H01H 21/00
(52) U.S. Cl. ..... 200/339; 200/517; 200/553
(58) Field of Search ..... 200/4, 5 R, 5 A, 200/517, 553, 561, 339

(56) References Cited

U.S. PATENT DOCUMENTS 4,434,340 A * 2/1984 Kondo ..... 200/332
5,149,924 A * 9/1992 Priesemuth ..... 200/5 R
5,712,459 A * 1/1998 Ziegler ..... 200/5 R
5,957,273 A * 9/1999 Karasik ..... 200/556
6,054,655 A * 4/2000 Rudolph et al. ..... 200/16 R
6,437,259 B1 * 8/2002 Geppert et al. ..... 200/5 R
6,605,790 B2 * 8/2003 Yoshida ..... 200/339

FOREIGN PATENT DOCUMENTS

JP 11-86683 3/1999

* cited by examiner

*Primary Examiner*—Michael A. Friedhofer
(74) *Attorney, Agent, or Firm*—Pillsbury Winthrop LLP

(57) ABSTRACT

A switch shaft connection shaft (24) is formed on a switch knob (22), and connected to a switch shaft (26). Therefore, the switch shaft (26) can move in response to an inclination restoration operation of the switch knob (22). Further, the switch shaft (26) has movement in the lateral direction regulated by a guide rail (17), which makes it possible to always exert pressing force vertically with respect to a tact switch (25). Moreover, a region where the tact switch (25) is pressed from the switch shaft (26) is constituted by a resilient member, which means that there is no striking noise when the switch shaft (26) strikes the tact switch (25), and it is possible to provide a switch unit that is quiet at the time of operation.

1 Claim, 4 Drawing Sheets

SWITCH UNIT

BACKGROUND OF THE INVENTION

1. Technical Field

The present invention relates to a switch unit, and particularly to a switch unit for preventing the generation of noise at the time of a switching operation.

2. Related Art

There are various types of switch units used in operation panels of various electronic devices, such as seesaw type switches that are a combination of a switch knob having a fulcrum at a central section and a tact switch, and a type that has a fulcrum at one end of a switch knob and is operated at the other end. In particular, with the high functionality and divergence of various devices in recent years, switches with an automatic reset function, where a switch knob returns to its original position after the switch has been operated and a hand removed, are being widely used.

This type of conventional switch unit will be described using FIG. 6, FIG. 7 and FIG. 8. FIG. 6 is an upper external view of a conventional switch unit. FIG. 7 is a cross sectional view of the switch unit shown in FIG. 6 taken along line D—D, and shows a stationary state where the switch is not operated. FIG. 8 is a cross sectional view of the switch unit shown in FIG. 6 taken along line D—D, and shows an operation state where the switch has been operated. These drawings show examples of a see-saw type switch unit.

The conventional switch unit is provided with a switch knob 12 capable of being tilted with a rotational shaft 11 in switch housing 10 as a center, and a switch operation is carried out by the switch operator pressing the upper surface of this switch knob. The switch operator performs ON and OFF operations of the switch unit by pressing close to the two ends of the switch knob 12, but a projection 13 is formed on a rear side of the section on the switch knob 12 pressed by the switch operator. This projection 13 is provided in order to supply pressing force to a resin type tact switch 15 fixed to a printed substrate 14, and this pressing force is exerted via a switch shaft 16 arranged by the tip of the projection 13. The switch shaft 16 has movement in the lateral direction regulated by a guide rail 17, and it is possible to always exert pressing force in a direction vertical with respect to the tact switch 15.

The tact switch 15 merely transmits an electrical signal to an ON/OFF hold circuit, not shown, in response to pressure from the switch operator, and the ON/OFF hold circuit (not shown) carries out switch turnover/detent. In this way, electrical signals are transmitted to an electronic device (not shown) etc. connected to the switch unit, and it is possible to carry out ON/OFF switching.

If the switch knob 12 is operated by a switch operator, the switch unit is put into a state as shown in FIG. 8, but when the operator releases the switch knob 12, the switch knob 12 will immediately return to the original position shown in FIG. 7. This automatic reset function is well known in the related art, and so detailed description will be omitted, but uses, for example, restoration force of a flexible switch (refer to Japanese Patent Laid-open Publication No. Hei 11-86683 for example), or causes restoration to an original position by providing a spring at a connecting section of a rotational shaft 11 and the switch knob 12 and utilizing resilient force of this spring.

However, with the above described switch unit of the related art, there is a problem in that when the switch knob 12 is restored to the original position, noise is generated as a result of the tip of the projection 13 hitting the switch shaft 16. In order to solve this problem, it has been considered to adopt a switch unit using a push-pull switch such as that disclosed in Japanese Patent Laid-open Publication No. Hei 11-86683, but it is necessary to change the structure of the switch unit significantly, and is not a realistic solution because it causes increase in cost.

The present invention is intended to solve the above described problems, and an object of the present invention is to provide a switch unit that does not significantly change a switch structure, suppresses striking noise generation and has a quiet operating sound.

SUMMARY OF THE INVENTION

In order to solve the above described problems, a switch unit of the present invention comprises a switch knob arranged capable of being tilted with a rotational shaft as a shaft center and provided with an automatic reset function for restoring to an original position, a switch shaft connection shaft provided on the switch knob, a switch shaft being moved in accordance with an inclination restoration operation as a result of connecting to the switch shaft connection shaft, a guide rail for guiding movement of the switch shaft in a straight line, and a tact switch, arranged capable of connection and disconnection to and from the switch shaft, for electrical connection and disconnection as a result of pressure from the switch shaft, wherein the tact switch has a region pressed from the switch shaft constituted by a resilient member.

DESCRIPTION OF THE PREFERRED EMBODIMENTS

Figure 1:
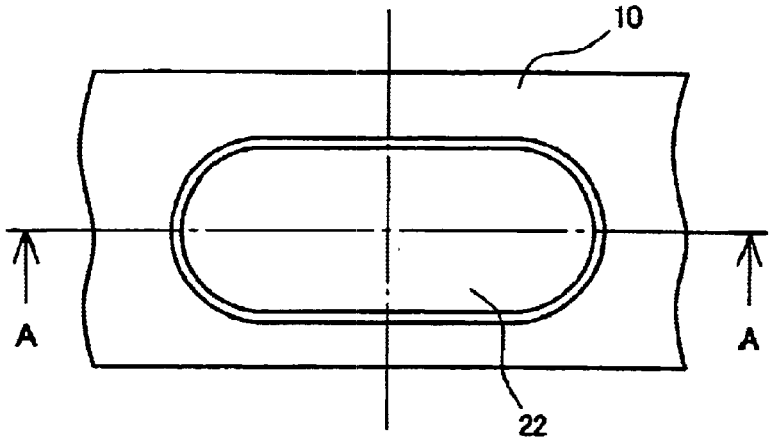
FIG. 1 is an upper external view of a switch unit of an embodiment of the present invention.
Figure 2:
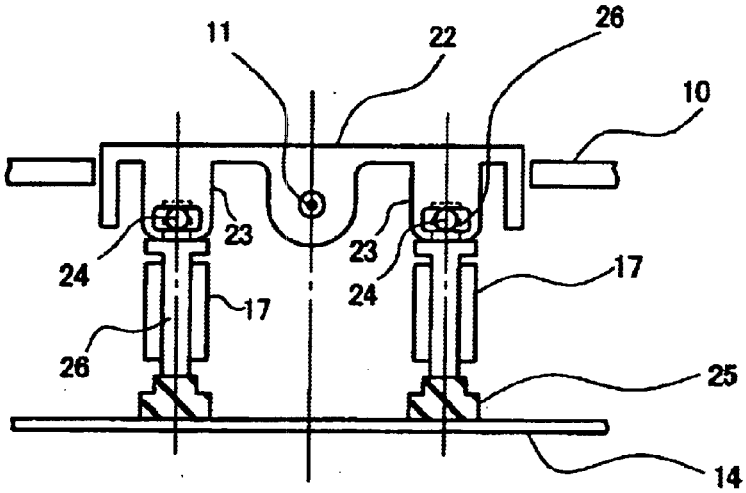
FIG. 2 is a cross sectional view of the switch unit shown in FIG. 1 taken along line A—A, and shows a stationary state where the switch knob is not operated.
Figure 3:
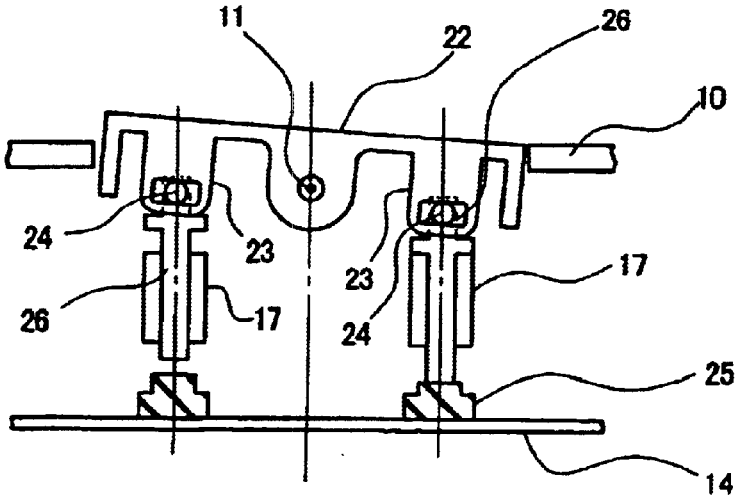
FIG. 3 is a cross sectional view of the switch unit shown in FIG. 1 taken along line A—A, and shows an operation state where the switch knob has been operated.

Preferred embodiments of the present invention will now be described using the attached the drawings. FIG. 1 is an upper external view of a switch unit of an embodiment of the present invention, FIG. 2 is a cross sectional view of the switch unit shown in FIG. 1 taken along line A—A showing a stationary state where the switch knob is not operated, and FIG. 3 is a cross sectional view of the switch unit shown in FIG. 1 taken along line A—A showing an operation state where the switch knob has been operated. The same reference numerals are assigned to parts that are the same as or analogous to those parts shown in the related art described above.

Figure 7:
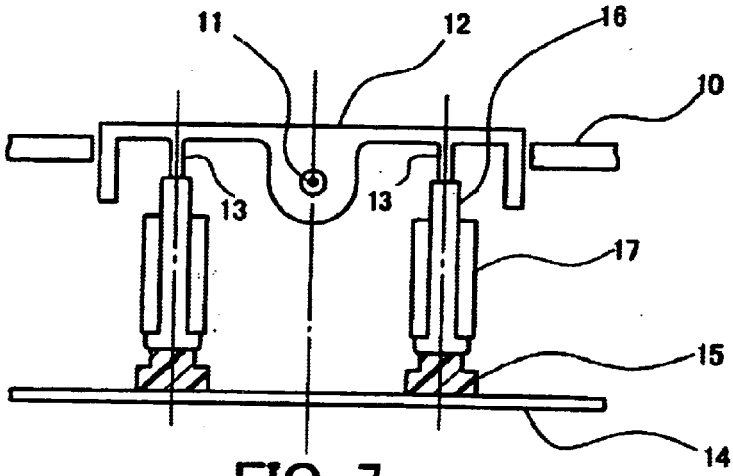
FIG. 7 PRIOR ART
FIG. 7 is a cross sectional view of the switch unit shown in FIG. 6 taken along line D—D, and shows a stationary state where the switch knob is not operated.
Figure 8:
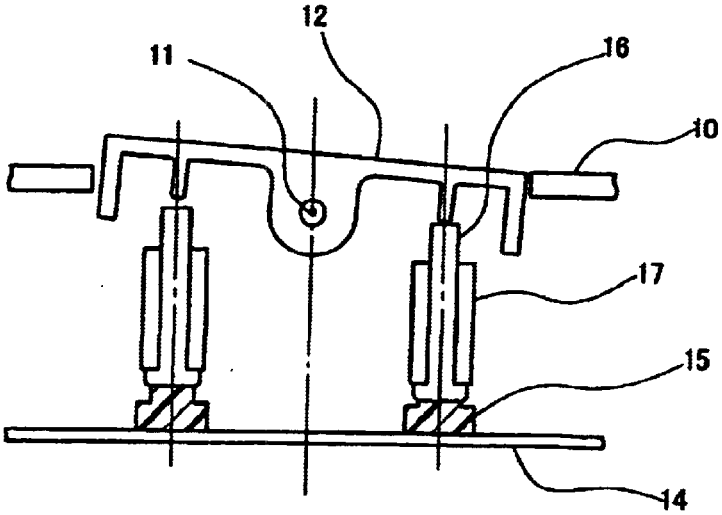
FIG. 8 PRIOR ART
FIG. 8 is a cross sectional view of the switch unit shown in FIG. 6 taken along line D—D, and shows an operation state where the switch knob has been operated.

As will be clear from FIG. 2 and FIG. 3, the characteristic feature of this embodiment is that a switch knob 22 and a switch shaft 26 are connected. Describing this connection structure in detail, a projection 23 for shaft connection is formed on the switch knob 22 at the same position as the projection 13 shown in the related art (refer to FIG. 7 and FIG. 8), and a switch shaft connection shaft 24 is formed on this shaft connection projection 23. The switch shaft 26 becomes capable of being moved in accordance with an inclination restoration operation of the switch knob 22, by being connected to the switch shaft connection shaft 24. Also, a guide rail 17 is arranged to the left and right of the switch shaft 26, and the switch shaft 26 is moved in a straight line with movement in the left and right direction being regulated by the guide rail 17. Accordingly, it is possible to always have pressing force exerted in a vertical direction with respect to the tact switch 25.

With the above described structure, that is, by connecting the switch knob 22 and the switch shaft 26, it is possible to prevent the generation of striking noise generated in the related art switch unit due to clashing of the switch knob 12 and the switch shaft 16. Here, if the structure of the switch unit of this embodiment is adopted, there is clashing of the switch shaft 26 and the tact switch 25, but with this embodiment, in order to prevent the striking noise due to clashing of the switch shaft 26 and the tact switch 25, a section where the tact switch 25 is pressed from the switch shaft 26 is made of a resilient member. Accordingly, striking noise is not generated even if the switch shaft 26 strikes the tact switch 25, and it is possible to provide a switch unit which is quiet at the time of switch operation. It is possible to use a well known resilient member such as rubber or silicone rubber as the resilient member used in the tact switch 25.

Figure 4B:
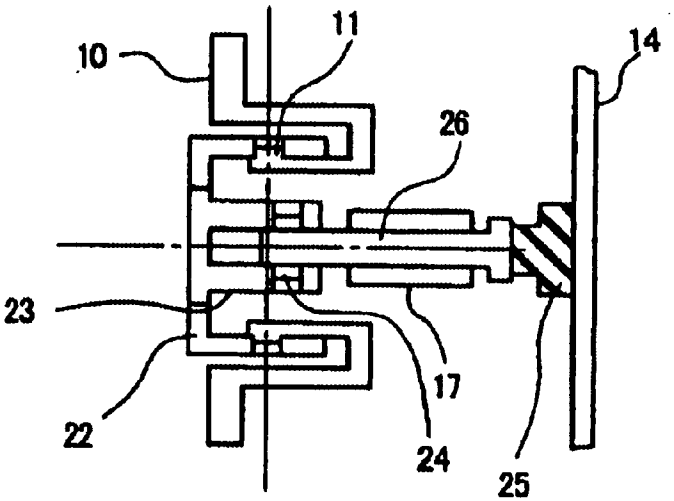
FIG. 4B shows a cross section along line B—B in FIG. 4A.
Figure 4A:
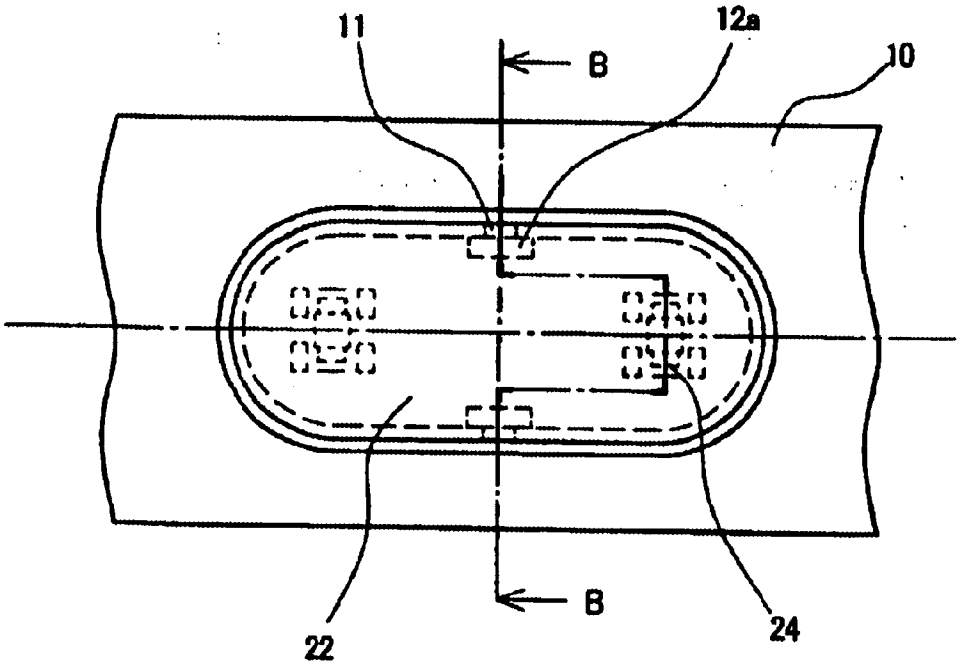
FIG. 4A is an upper external view of a switch unit of an embodiment of the present invention.

Also, as a preferred operation of this embodiment, there is the advantage that shaking of the switch knob 22 is reduced compared to the switch unit of the related art. By reducing this shaking, there is the effect of improving feeling at the time of switch operation compared to the switch unit of the related art. This point will be described using FIG. 4A, FIG. 4B, FIG. 5A and FIG. 5B. Here, FIG. 4A is an upper external view of a switch unit of an embodiment of the present invention, while FIG. 4B shows a cross section along line B—B in FIG. 4A. FIG. 5A is an upper external view of a switch unit of the related art, with FIG. 5B showing a cross section along line C—C in FIG. 5A.

Figure 5B:
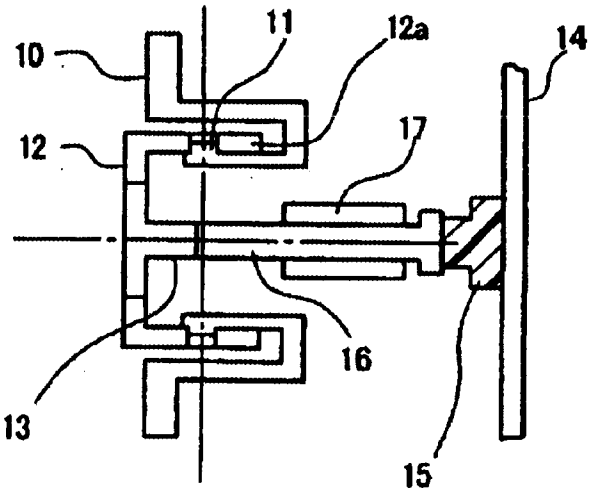
FIG. 5B shows a cross section along line C—C in FIG. 5A.
Figure 5A:
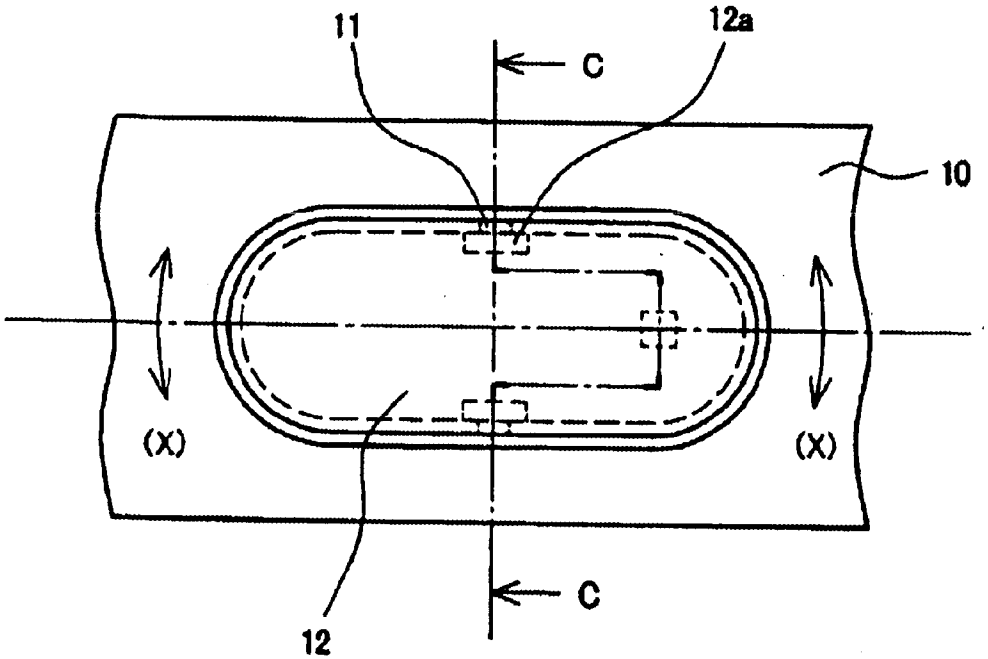
FIG. 5A is an upper external view of a switch unit of the related art.
Figure 6:
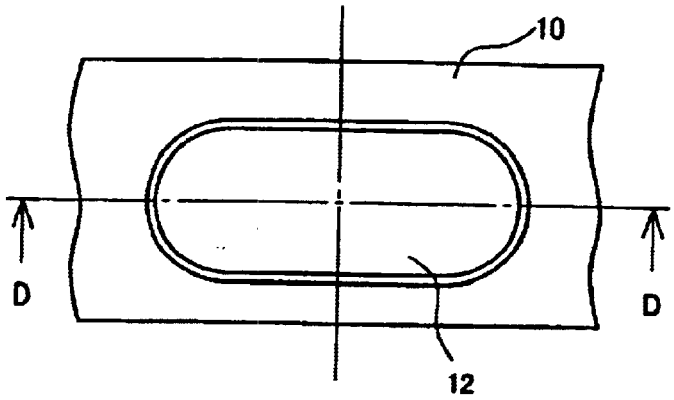
FIG. 6 PRIOR ART
FIG. 6 is an upper external view of a conventional switch unit.

With the related art switch unit shown in FIG. 5A and FIG. 5B, the switch knob 12 is only supported by a rotation shaft 11 formed in the switch housing 10 and a bearing surface 12*a* provided on the switch knob 12. Therefore, the switch knob 12 of the related art has the disadvantage of mechanically shaking in the direction of the arrow (X) shown in FIG. 5(A). In order to stop this shaking, it has been considered to widen the surface area of the bearing surface 12*a*, but with this method, the sliding resistance between the rotation shaft 11 and the bearing surface 12*a* is increased, which reduces the feeling of the switch operation, and it is difficult to prevent shaking with the structure of the related art.

On the other hand, according to the switch unit of this embodiment shown in FIG. 4A and FIG. 4B, the switch knob 22 is connected to the switch shaft 26, and also the switch shaft 26 has movement in the lateral direction regulated by the guide rail 17, which means that a structure is obtained that makes it difficult for shaking to occur. Therefore, according to this embodiment, it is possible to provide a switch unit which prevents shaking of the switch knob 22, and which also improves feeling at the time of switch operation.

In FIG. 4B, there are two shaft connection projections 23 provided, on either side of the switch shaft 26, but it is possible to prevent shaking of the switch knob 22 if only one of them is provided.

Also, with this embodiment, description has been given with a see-saw type switch unit as an example, but it is also possible to apply the switch unit to any type of switch, such as a switch knob that has a fulcrum at one end and is operated by the other end, or a switch unit where the switch knob can be inverted in a number of directions.

As has been described above, according to the present invention, it is possible to provide a switch unit that suppresses striking noise without significantly changing the switch structure, and which is quiet when operated.

Also, by connecting the switch knob to the switch shaft, it is possible to prevent the switch knob shaking, which means that it is possible to provide a switch unit with improved feeling at the time of operation.

What is claimed is:

1. A switch unit, comprising:

a switch knob arranged capable of being tilted with a rotational shaft at a shaft center and provided with an automatic reset function for restoring to an original position;

a switch shaft connection shaft provided on the switch knob;

a switch shaft being moved in accordance with an inclination restoration operation as a result of connecting to the switch shaft connection shaft;

a guide rail for guiding movement of the switch shaft in a straight line; and a tact switch, arranged capable of connection and disconnection to and from the switch shaft, for electrical connection and disconnection as a result of pressure from the switch shaft, wherein the tact switch has a region pressed from the switch shaft and constituted by a resilient member.

* * * * *